US007174674B2

(12) United States Patent
Hattori et al.

(10) Patent No.: US 7,174,674 B2
(45) Date of Patent: Feb. 13, 2007

(54) AUTOMATIC OPENING/CLOSING DEVICE FOR VEHICLE

(75) Inventors: Takeshi Hattori, Tokyo (JP); Yasushi Yoshida, Kiryu (JP)

(73) Assignees: Honda Motor Co., Ltd., Tokyo (JP); Mitsuba Corporation, Gunma (JP)

( * ) Notice: Subject to any disclaimer, the term of this patent is extended or adjusted under 35 U.S.C. 154(b) by 6 days.

(21) Appl. No.: 10/742,331

(22) Filed: Dec. 19, 2003

(65) Prior Publication Data

US 2004/0134129 A1 Jul. 15, 2004

(30) Foreign Application Priority Data

Dec. 20, 2002 (JP) ..... 2002-369966

(51) Int. Cl.
*E05F 11/08* (2006.01)

(52) U.S. Cl. ..... 49/344; 49/340; 49/341; 296/56

(58) Field of Classification Search ..... 49/339, 49/340, 341, 342, 344; 296/56
See application file for complete search history.

(56) References Cited

U.S. PATENT DOCUMENTS 6,092,337 A 7/2000 Johnson et al. ..... 49/340
6,142,551 A * 11/2000 Ciavaglia et al. ..... 296/56
6,401,392 B1 * 6/2002 Yuge ..... 49/340
6,637,157 B1 * 10/2003 Dombrowski et al. ..... 49/341
6,834,463 B2 * 12/2004 Fukumoto et al. ..... 49/341
2001/0047625 A1 * 12/2001 Sedlak et al. ..... 49/341

FOREIGN PATENT DOCUMENTS

JP 2000253241 A 9/2000
JP 2001-253241 9/2001
JP 2002-087065 3/2002
JP 2002-536569 10/2002

* cited by examiner

*Primary Examiner*—Jerry Redman
(74) *Attorney, Agent, or Firm*—McCormick, Paulding & Huber LLP

(57) ABSTRACT

The invention improves accuracy of engagement of a pinion and a rack with each other in an automatic opening/closing device for a vehicle. In the automatic opening/closing device for the vehicle and for automatically opening and closing an opening/closing member provided to a vehicle body, the device includes a motor for generating a driving force for driving a pinion for rotation, a sliding member having a rack engaged with the pinion, and a rail member for positioning the sliding member and for guiding the sliding member in a predetermined direction. The sliding member and the opening/closing member are connected through a connecting rod. A base member is integrally formed with a motor fixing portion and a rail fixing portion. The motor and the rail member are fixed to the base member. As a result, it is easy to improve accuracy of positioning of the pinion and the rack and to improve accuracy of engagement of the pinion and the rack with each other.

8 Claims, 7 Drawing Sheets

AUTOMATIC OPENING/CLOSING DEVICE FOR VEHICLE

This application is entitled to the benefit of and incorporates by reference essential subject matter disclosed in Japanese Patent Application No. 2002-369966filed on Dec. 20, 2002.

TECHNICAL FIELD OF THE INVENTION

The present invention relates to an automatic opening/closing device for a vehicle and particularly to a technique advantageous when it is applied to opening/closing of a back door, a trunk lid, an engine hood, a door, and the like.

BACKGROUND OF THE INVENTION

As an opening/closing member mounted to a vehicle such as an automobile, there are a back door, a trunk lid, and the like for opening/closing by pivoting and swinging about a hinge and a slide door and the like for opening/closing by moving along a rail.

For example, there are many one-box cars provided with a back door such that baggage can easily be loaded and unloaded from a rear portion of the vehicle. Normally, such a backdoor is mounted through a hinge fixed to a rear end portion of the vehicle body and pivots about the hinge to open and close in a vertical direction. In this case, the back door is also called a flip-up back door because the back door is flipped up high above the vehicle.

Such a back door is flipped up high when opening in many cases to produce a large clearance between an end portion of the back door and the ground and therefore opening and closing of the back door are difficult. Especially for women and children, it is extremely difficult to close such a back door.

Therefore, vehicles mounted with an automatic opening/closing device for enabling women and children to easily open and dose the backdoor are on the increase. Such an automatic opening/closing device includes a pinion driven by a motor which is a driving source and a rack engaged with the pinion, for example, and the rack and the back door are connected by a connecting rod. In automatically opening and closing the back door, power for opening and closing is transferred to the back door through the connecting rod from the rack driven for moving straight by the motor (see Japanese Patent Application Laid-open No. 2001-253241 for example).

However, in mounting the motor, the pinion, and the rack, these parts are fixed to different reference members. By piling a plurality of reference members, the automatic opening/closing device is formed. Because many parts are mounted in this manner, it is difficult to improve accuracy of engagement of the pinion and the rack with each other and such structure may cause wear of engaged faces and generation of engaging sounds. Moreover, reduction in the accuracy of the engagement is undesirable from a viewpoint of power transferring efficiency.

Combination of many parts results not only in increase in cost of the automatic opening/closing device due to increase in the number of parts but also in reduction in vehicle mountability due to fostering of upsizing of the automatic opening/closing device.

SUMMARY OF THE INVENTION

It is an object of the present invention to enhance accuracy of engagement of a pinion and a rack with each other in an automatic opening/closing device for a vehicle.

It is another object of the invention to achieve downsizing of the automatic opening/closing device for the vehicle.

According to the invention, there is provided an automatic opening/closing device for a vehicle for automatically opening and closing an opening/closing member provided to a vehicle body, the device comprising: a motor for generating a driving force for driving a pinion for rotation; a sliding member which includes a rack engaged with the pinion and which is connected to the opening/closing member through a connecting member; a rail member which positions the sliding member driven forward and rearward through the pinion and which guides the sliding member in a predetermined direction; and a base member to which the motor and the rail member are fixed respectively.

The automatic opening/closing device for the vehicle according to the invention is characterized in that the pinion is rotatably supported on the base member.

The automatic opening/closing device for the vehicle according to the invention is characterized in that the base member includes a motor fixing portion and a rail fixing portion which are formed integrally.

The automatic opening/closing device for the vehicle according to the invention is characterized in that the base member includes a motor fixing portion, a rail fixing portion, and a pinion support portion, which are formed integrally.

According to the invention, by fixing the motor and the rail member to the one base member, it is possible to improve the accuracy of the engagement of the pinion driven by the motor and the rack of the sliding member positioned by the rail member with each other. As a result, it is possible to increase power transferring efficiency in opening and closing the opening/closing member and to reduce wear in engaged faces of and generation of engaging sounds of the pinion and the rack.

In the case where the pinion is provided as a separate body from the motor, it is possible to improve the accuracy of the engagement of the pinion and the rack with each other by supporting the pinion by the base member to which the motor and the rail member are fixed.

Furthermore, by integrally forming the base member, it is possible to remove a factor of a decrease in positioning accuracy due to assembly of a base member and to further improve the accuracy of the engagement of the pinion and the rack with each other. By integrally forming the base member, it is possible to enhance rigidity of the base member and to maintain high accuracy of the engagement of the pinion and the rack with each other.

Furthermore, by integrally forming the base member, constraints on setting of positions of the motor fixing portion and the rail fixing portion are eased and the motor and the rail member can be gathered and disposed. As a result, the automatic opening/closing device for the vehicle can easily be downsized. It is also possible to reduce cost by reducing the number of parts.

DESCRIPTION OF THE PREFERRED EMBODIMENTS

An embodiment of the present invention will be described below in detail based on the drawings.

Figure 1:
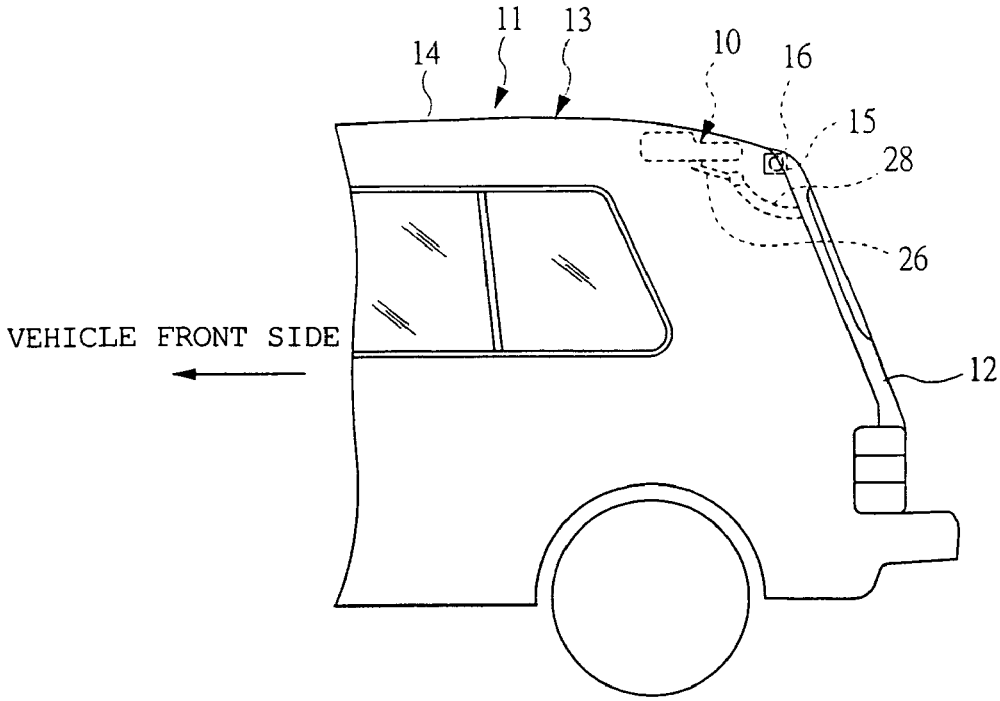
FIG. 1 is a side view of a portion of a vehicle mounted with an automatic opening/closing device for a vehicle and which is an embodiment of the present invention.
Figure 2:
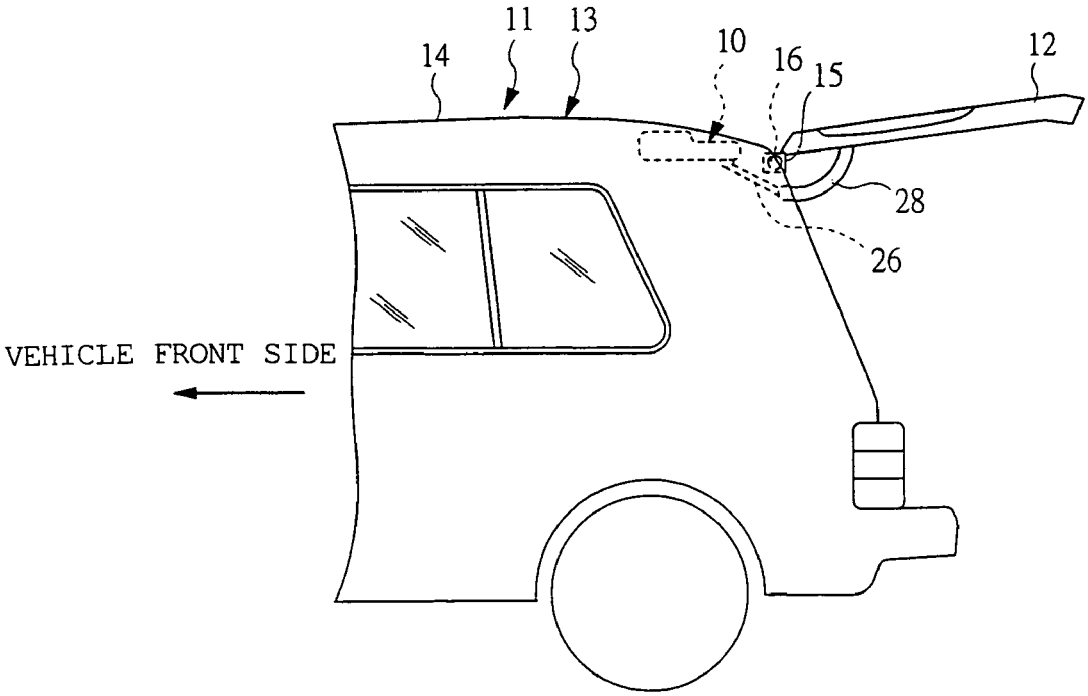
FIG. 2 is a side view of a portion of the vehicle with its back door in FIG. 1 open.

FIG. 1 is a side view of a portion of a vehicle 11 mounted with an automatic opening/closing device 10 (hereafter referred to as an opening/closing device) for a vehicle and which is an embodiment of the invention. FIG. 2 is a side view showing an open state of a back door 12 in FIG. 1.

As shown in FIGS. 1 and 2, the back door 12 which is an opening/closing member is provided to a rear end portion of a vehicle body 13 constituting the vehicle 11. A hinge 15 is provided to a rear end of a roof portion 14 forming an upper portion of the vehicle body 13 and the back door 12 is mounted to be able to swing to the vehicle body 13 through the hinge 15. The back door 12 pivots about a pin 16 mounted into the hinge 15 and can open and close in a range of about 90° between a fully-closed state shown in FIG. 1 and a fully-open state shown in FIG. 2.

Although the back door 12 shown in the drawings is mounted to open and close in a vertical direction with respect to the vehicle body 13, the invention is not limited to this. It is possible that the hinge 15 is mounted to a side portion of the rear end of the vehicle body 13 and that the back door 12 is opened and closed in a horizontal direction with respect to the vehicle body 13. It is also possible that the hinge 15 is mounted to each of opposite side portions of the rear end of the vehicle body 13 to form the back door as a set of double doors. An opening/closing range of the back door 12 is not limited to about 90° but may be set arbitrarily.

Figure 3:
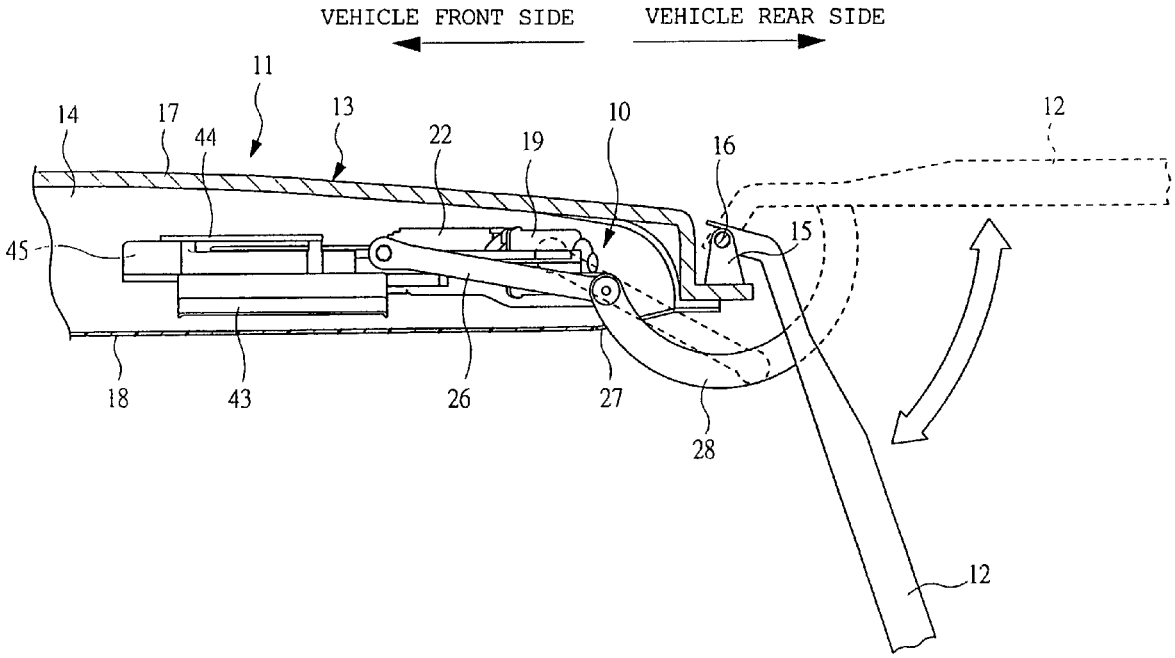
FIG. 3 is an enlarged side view of the automatic opening/closing device for the vehicle and in FIGS. 1 and 2.
Figure 4:
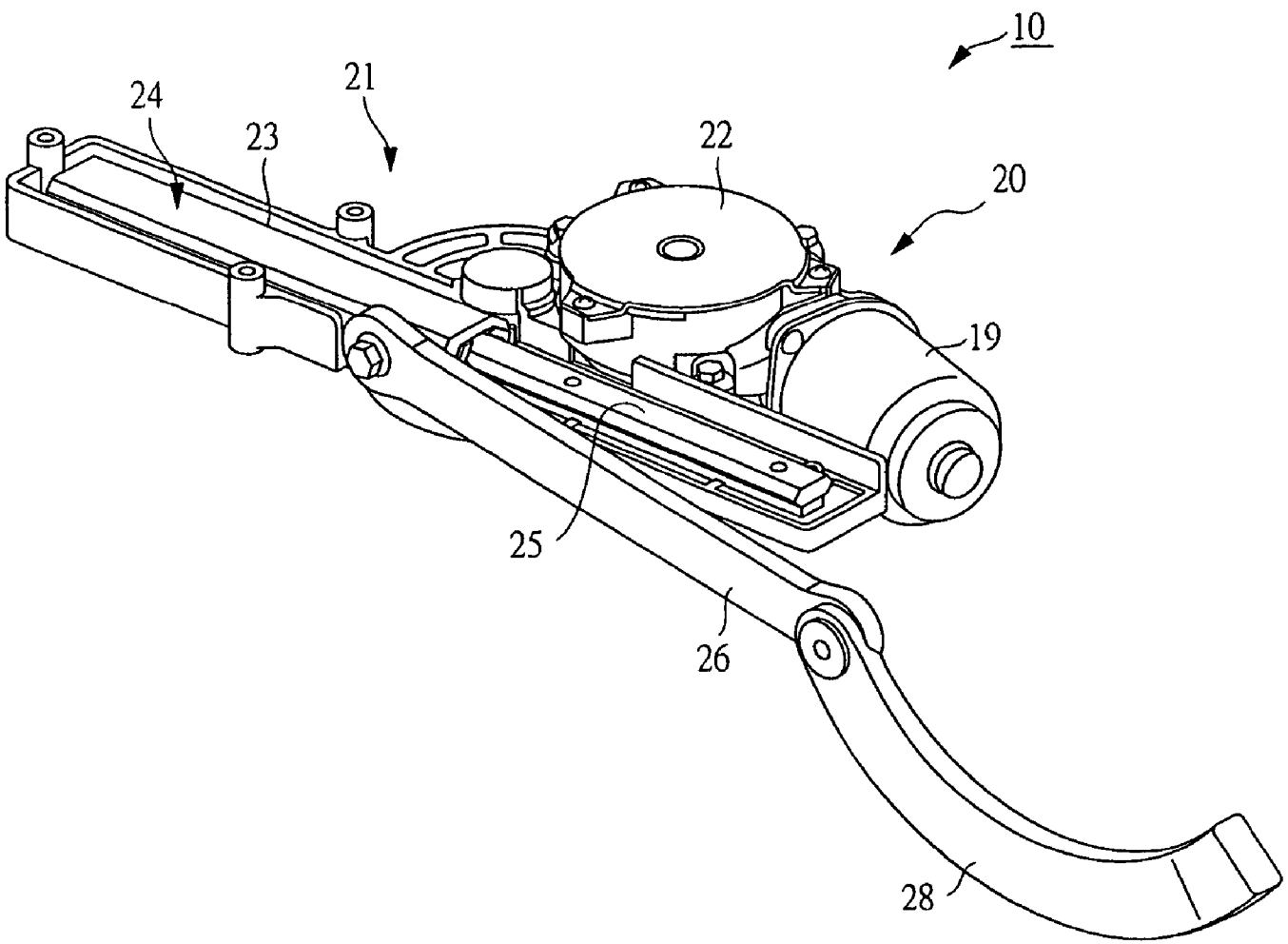
FIG. 4 is a perspective view of the automatic opening/closing device for the vehicle.

To the roof portion 14 of the vehicle body 13, the opening/closing device 10 for automatically opening and closing the back door 12 is provided. Here, FIG. 3 is an enlarged side view of the opening/closing device 10 in FIGS. 1 and 2 and FIG. 4 is a perspective view of the opening/closing device 10. As shown in FIG. 3, the opening/closing device 10 is provided between a roof panel 17 forming the roof portion 14 and a roof lining 18. As shown in FIG. 4, the opening/closing device 10 is formed of a power generating portion 20 for generating power to open and close the back door 12 with a motor 19 and of a power converting portion 21 for converting rotary motion of the motor 19 into linear motion and transferring the motion to the back door 12.

To the motor 19 provided to the power generating portion 20, a gear case 22 is mounted. In the gear case 22, a reduction gear mechanism formed of a worm and a worm wheel (not shown) is housed. A driving force of the motor 19 is transferred from the worm to the worm wheel, converted into a predetermined driving force, and then output from the reduction gear mechanism. The power converting portion 21 includes a sliding member 24 on one side face of which a rack 23 is formed and includes a rail member 25 for positioning the sliding member 24 in a width direction and for guiding the member 24 in a straight direction of moving. To the other side face of the sliding member 24, an end of a connecting rod 26 as a connecting member is mounted for swinging. The other end of the connecting rod 26 projecting from an opening portion 27 formed in the roof lining 18 is mounted for swinging to a curved arm 28 fixed to the back door 12. Between the motor 19 and the rack 23, a middle gear 29 and a pinion 30 which will be described later are provided. The driving force passing through the reduction gear mechanism is transferred to the rack 23 through the middle gear 29 and the pinion 30.

Figure 5:
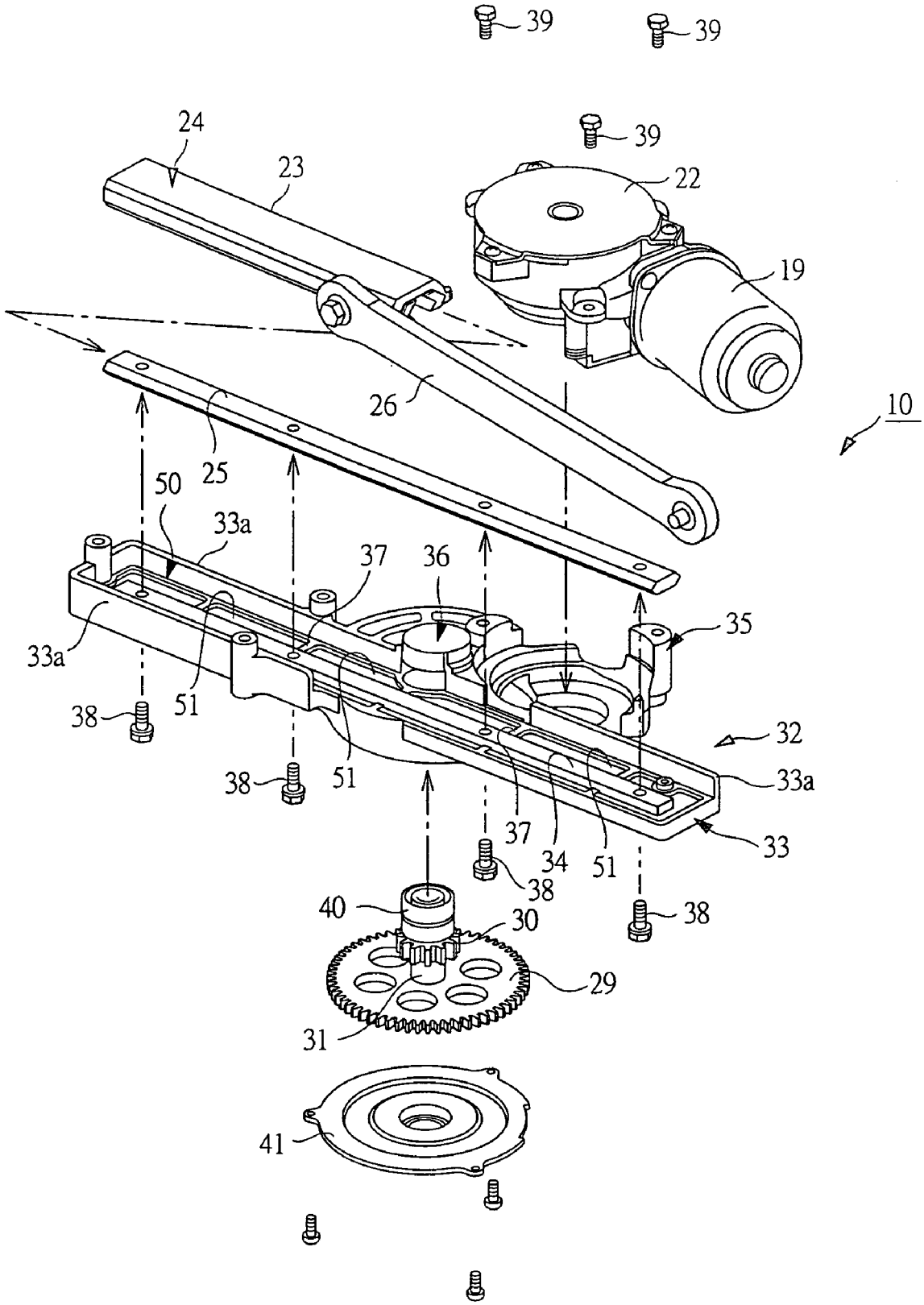
FIG. 5 is an exploded perspective view of the automatic opening/closing device for the vehicle.

FIG. 5 is an exploded perspective view of the opening/closing device 10. As shown in FIG. 5, in the opening/closing device 10, the middle gear 29 and the pinion 30 for transferring the driving force which has passed through the reduction gear mechanism to the rack 23 are provided coaxially and are connected to each other through a support shaft 31. The middle gear 29 is engaged with an output gear 46 which is provided to the reduction gear mechanism and which will be described later. The pinion 30 for rotation with the middle gear 29 is engaged with the rack 23 formed in the sliding member 24.

The opening/closing device 10 is provided with a base member 32 to which the motor 19 and the rail member 25 are fixed and on which the support shaft 31 of the pinion 30 and the middle gear 29 is rotatably supported. The base member 32 includes a rail fixing portion 34 formed in a projecting shape through a longitudinal direction of and on a surface of a base portion 33 formed in a shape of a rectangular plate; a motor fixing portion 35 provided to a side face of the base portion 33 to be open upward; and a pinion support portion 36 which is adjacent to the motor fixing portion 35 and is provided to the side face of the base portion 33 to be open downward. The base member 32 including these motor fixing portion 35, rail fixing portion 34, and pinion support portion 36 is formed integrally by die casting by using metal material such as aluminum. On the surface of the base portion 33 formed to extend in the longitudinal direction, a plurality of ribs 37 and a wall portion 33*a* are formed to enhance rigidity of the base member 32.

The rail member 25 is fixed to the rail fixing portion 34 by using a plurality of screw members 38 and the sliding member 24 is mounted for sliding and such that the rail member 25 is pinched at its opposite side faces in the sliding member 24. The gear case 22 of the motor 19 is fixed to the motor fixing portion 35 by using a plurality of screw members 39 and the gear case 22 is mounted to be housed in the motor fixing portion 35. The pinion 30 and the middle gear 29 are rotatably supported in the pinion support portion 36 by fitting of an outer ring of a bearing 40 mounted to the support shaft 31 in the pinion support portion 36. An opening portion of the pinion support portion 36 is closed with a cover member 41 and is supported on a bearing (not shown) disposed on the other end side of the support shaft 31.

The wall portion 33*a* of the base member 32 is formed so as to rise up with approximately 90 degrees to the surface of the base portion 33. The wall portion 33*a* is formed in one side-edge of the base portion 33 so as to face to the rack 23, and formed to extend up to around a center portion of the other side-edge of the base portion 33 through a front edge of the base portion 33 provided toward the vehicle front. The wall portion 33*a* formed as such surrounds the sliding member 24, so that a groove portion 50 is formed in the base member 32 by the base portion 33 and the wall portion 33*a*. Further, groove portions 51 are formed into sections divided by the ribs 37 on the base portion 33 of the base member 32.

Figure 6:
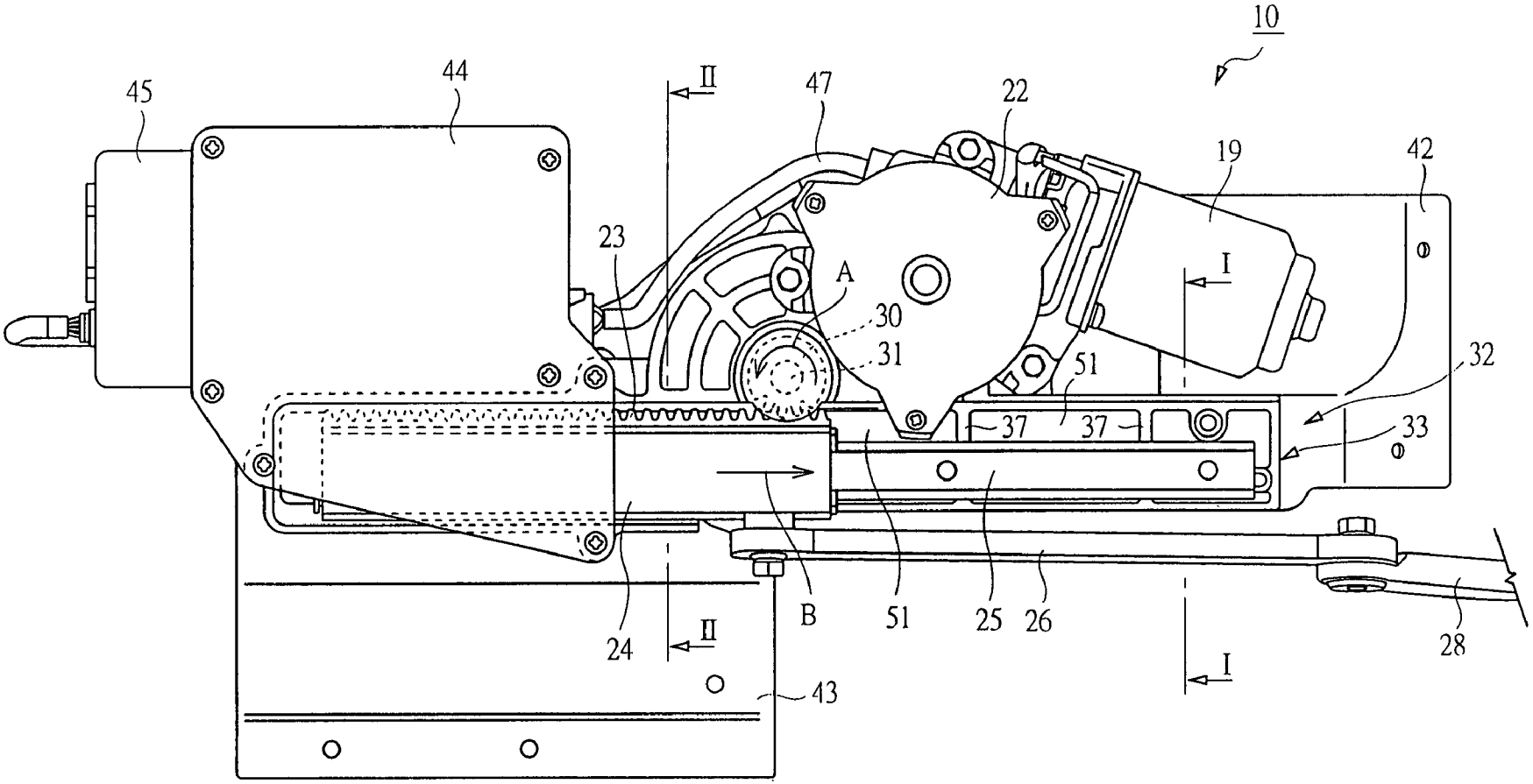
FIG. 6 is a plan view of the automatic opening/closing device for the vehicle and viewed from a roof panel side.
Figure 7:
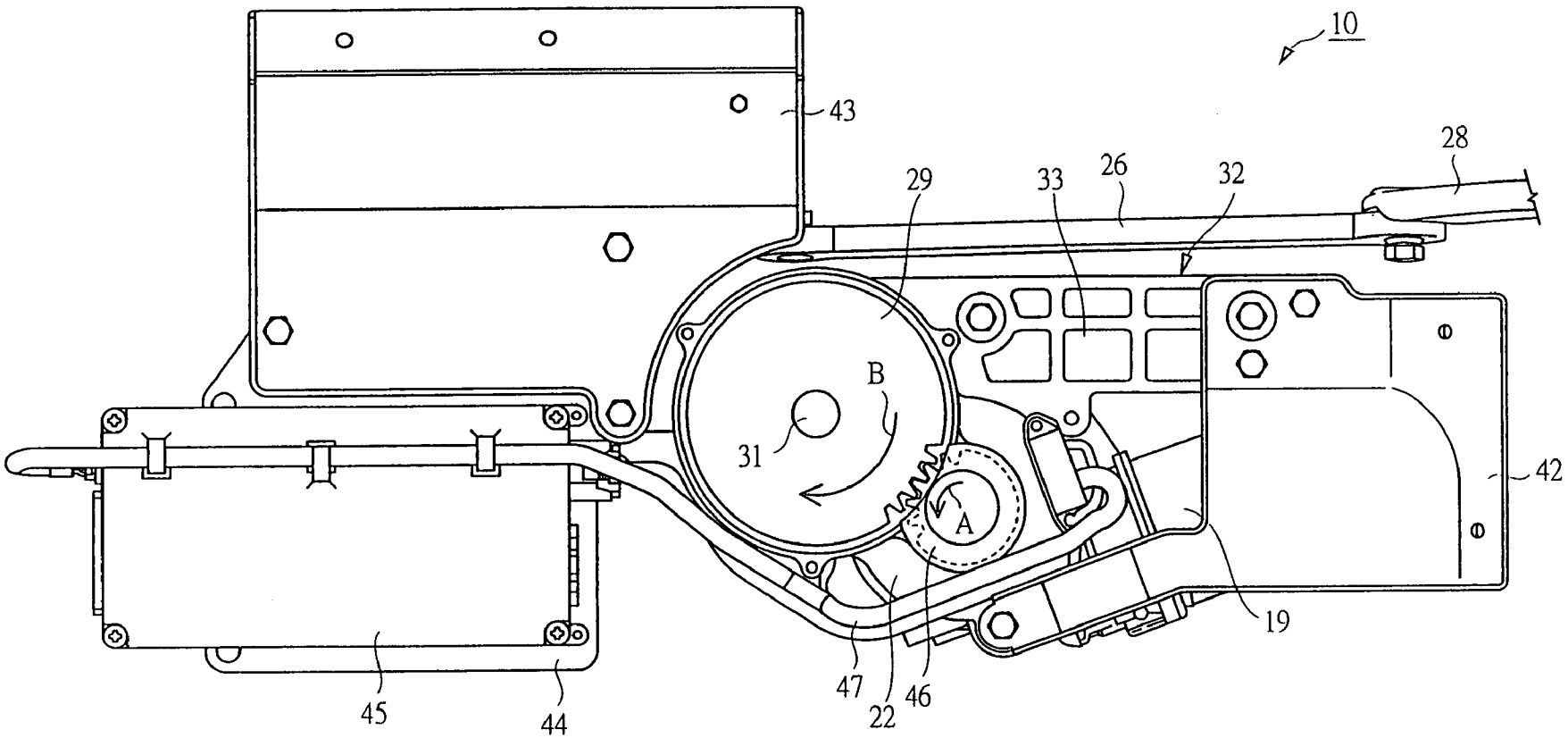
FIG. 7 is a plan view of the automatic opening/closing device for the vehicle and viewed from a ceiling lining side.
Figure 8A:
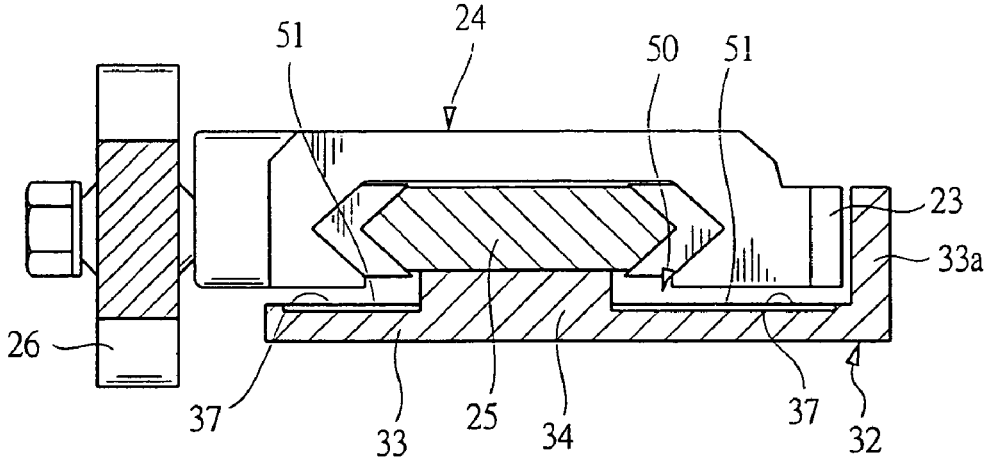
FIG. 8A is a sectional view of the automatic opening/closing device for the vehicle taken along line I—I in FIG. 6.
Figure 8B:
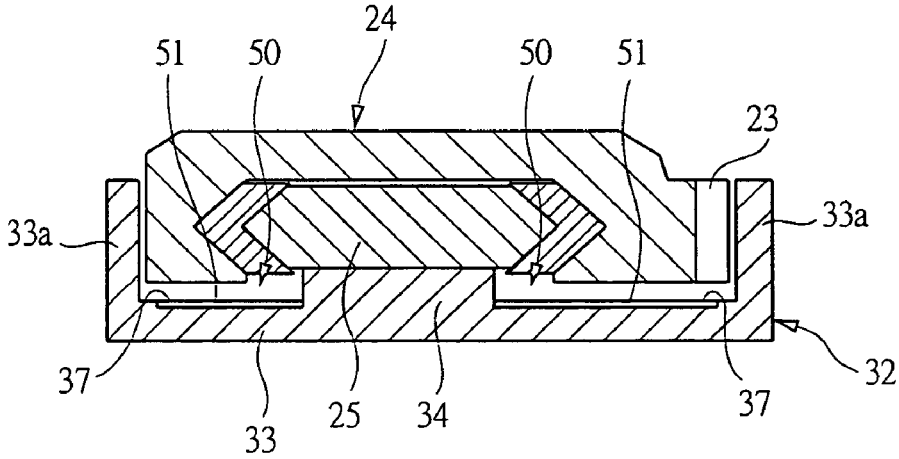
FIG. 8B is a sectional view of the automatic opening/closing device for the vehicle taken along line II—II in FIG. 6.

FIG. 6 is a plan view of the opening/closing device 10 viewed from a roof panel 17 side. FIG. 7 is a plan view of the opening/closing device 10 viewed from the ceiling lining 18 side. Further, FIG. 8A is a sectional view of the base member 32 and the sliding member 24 taken along the line I—I in FIG. 6, and FIG. 8B is a sectional view of the base member 32 and the sliding member 24 taken along the line II—II in FIG. 6. The opening/closing device 10 in FIGS. 6 and 7 is shown in a state in which brackets 42 to 44 mounted to the base member 32 and a control unit 45 for controlling driving of the motor 19 are mounted and a part of cogs formed on various gears are omitted. FIG. 7 shows a state in which the cover member 41 for closing the pinion support portion 36 is detached.

In the respective gears 23, 29, 30, and 46 mounted to the base member 32, as shown in FIGS. 6 and 7, the output gear 46 provided to the reduction gear mechanism and the middle gear 29 fixed to the support shaft 31 are engaged with each other and the pinion 30 connected to the middle gear 29 through the support shaft 31 and the rack 23 of the sliding member 24 are engaged with each other. In other words, a rotational driving force from the motor 19 is transferred to the rack 23 through the output gear 46, the middle gear 29, and the pinion 30 to drive the sliding member 24 forward and rearward. The tooth flanks of the pinion 30 and the rack 23 both engaging as such is applied with grease as lubricant in order to prevent wearing of the tooth flank and to reduce the engaging noise.

As shown in FIG. 8A, the base portion 33 constituting the base member 32 is formed to be extending under the rack 23, so that the underside of the rack 23 is surrounded by the base member 32. Further, the wall portion 33*a* constituting the base member 32 is formed to have a predetermined height so as to face to the rack 23. Furthermore, as shown in FIG. 8B, in the front edge of the base member 32 provided toward the vehicle front, the wall portion 33*a* is also formed in the edge of the base portion 33 at the side of the connecting rod 26 because such portion is not likely to interferer with the connecting rod 26. The base member 32 provided with such base portion 33 and the wall portion 33*a* surrounds the bottom of the sliding member 24 and the rack 23 from their undersides.

As shown in FIGS. 6 and 7, the plurality of fixing brackets 42 and 43 are mounted to the base member 32 and the opening/closing device 10 is fixed to the roof panel 17 through the fixing brackets 42 and 43. A bracket 44 for a control unit is mounted to the base member 32 and is mounted with the control unit 45 for controlling supply of current to the motor 19 based on a manipulate signal from an opening/closing switch (not shown). A feeder 47 is provided between the motor 19 and the control unit 45 and the control unit 45 controls driving of the motor 19 through the feeder 47.

Next, opening/closing operations of the back door 12 by the opening/closing device 10 will be described. In the case where the fully-closed state of the back door 12 as shown in FIG. 1, when the opening/closing switch is operated in an opening direction by a driver, current for driving the motor 19 is supplied from the control unit 45. The rotational driving force of the motor 19 drives the output gear 46 for rotation in a direction of an arrow A in FIG. 7 through the reduction gear mechanism. As the output gear 46 rotates, the middle gear 29 is driven for rotation in a direction of an arrow B and drives the pinion 30 for rotation through the support shaft 31. As shown in FIG. 6, the pinion 30 is driven for rotation in a direction of an arrow A and the sliding member 24 is driven for moving straight toward the vehicle rear side as shown with an arrow B and while being guided with the rail member 25. The connecting rod 26 connected to the sliding member 24 moves from a position shown in a solid line to a position shown in a broken line in FIG. 3 so that the sliding member 24 moves and the connecting rod 26 opens the back door 12 to a fully-open position shown in a broken line through the arm 28.

On the other hand, if the opening/closing switch is operated in a closing direction, current supplied from the control unit 45 to the motor 19 is supplied in a reverse direction. Therefore, the respective gears 29, 30, and 46 rotate in reverse directions to the above-described directions of rotation. As a result, the sliding member 24 is driven for moving straight toward the vehicle front side and the back door 12 is closed to a fully-closed position shown in a solid line in FIG. 3 through the connecting rod 26.

As described above, the driving force from the motor 19 is transferred to the back door 12 through the engagement of the respective gears 23, 29, 30, and 46 with each other. Here, the motor 19 having the output gear 46, the rail member 25 for positioning the rack 23 of the sliding member 24 in the width direction, and the pinion 30 and the middle gear 29 for connecting the output gear 46 and the rack 23 are fixed or supported onto the motor fixing portion 35, the rail fixing portion 34, and the pinion support portion 36 formed on the same base member 32, so that it is easy to improve accuracy of positioning the output gear 46, the pinion 30, the middle gear 29, and the rail member 25 and it is possible to improve accuracy of engagement of the respective gears 23, 29, 30, and 46 with each other.

By integrally forming the base member 32 including the motor fixing portion 35, the rail fixing portion 34, and the pinion support portion 36, it is possible to remove a factor of a decrease in positioning accuracy which may be caused in a built-up base member. As a result, it is possible to position the motor fixing portion 35, the rail fixing portion 34, and the pinion support portion 36 with high accuracy and to improve the accuracy of the engagement of the respective gears 23, 29, 30, and 46 with each other.

Moreover, by integrally forming the base member 32, it is possible to enhance rigidity of the base member 32. By using the base member 32 with high rigidity, it is possible to maintain the accuracy of the engagement of the respective gears 23, 29, 30, and 46 with each other and to avoid deterioration of the accuracy of the engagement due to secular changes. As a result, it is possible to improve durability of the opening/closing device 10.

Furthermore, by integrally forming the base member 32, constraints on setting of positions of the motor fixing portion 35 and the rail fixing portion 34 are eased and the motor 19 and the rail member 25 can be gathered and disposed. In the case shown in the drawings, because the motor 19 and the sliding member 24 with large volumes are disposed to overlap each other in a horizontal direction of the vehicle 11, the opening/closing device 10 is downsized, i.e., made thin. It is also possible to reduce cost by reducing the number of parts.

Further, when opening/closing the back door 12, the rack 23 is to move above the base portion 33, so that the grease applied on the rack 23 may drop from the rack. Even in the case, the base member 32 can receive the dropped grease because the base member 32 is provided under the rack 23 so as to cover the moving track of the rack 23. This arrangement can avoid adhering the grease onto the roof lining 18 provided under the base member 32, so that can prevent contamination and loss of the roof lining 18.

Furthermore, since the groove portions 50 and 51 are formed in the base member 32 by the wall portion 33*a* and the ribs 37, the grease dropped onto the base member 32 is held in the groove portions 50 and 51. Even if the viscosity of the grease is decreased by rise of temperature inside the vehicle, this arrangement can avoid the greases flowing down from the base member 32, so that can secure the roof lining 18 from its contamination and loss.

As described above, in the opening/closing device 10 of the invention, by employing the unified base member 32 relative to which the respective gears 23, 29, 30, and 46 are positioned, it is possible to easily improve the accuracy of the engagement of the respective gears 23, 29, 30, and 46 with each other. As a result, it is possible to increase power transferring efficiency in transferring the driving force from a driving side, i.e., the motor 19 to a driven side, i.e., the sliding member 24 and to reduce wear in engaged faces of and generation of engaging sounds of the respective gears 23, 29, 30, and 46.

It is needless to say that the invention is not limit to the above embodiment and that various changes can be made without departing from a gist of the invention. For example, although the opening/closing member is the back door 12 mounted to the rear end portion of the vehicle body 13 in the present embodiment, the member is not limited to this but may be other opening/closing members such as a door, a trunk lid, an engine hood, a sunroof, a slide door, and the like as far as the member is mounted to the vehicle body 13 to be able to open and close.

Although the pinion 30 is driven by the motor 19 through the middle gear 29, the pinion 30 may directly be driven by the motor 19. In this case, the motor 19 and the rail member 25 are fixed to the base member 32.

Although the opening/closing device 10 is mounted to the roof portion 14 of the vehicle body 13, it may be mounted to another portion of the vehicle body 13. For example, the opening/closing device 10 may be mounted in a pillar provided to a rear portion of the vehicle body 13 to open and close the back door 12.

Although the base member 32 is made of aluminum, it may be made by using other metal materials or may be made by using materials other than metal materials as far as the materials have rigidity required of the base member 32. The base member 32 may be formed not by die casting but by cutting.

Although the back door 12 is opened and closed by using only the opening/closing device 10, a gas cylinder may be used in addition to the opening/closing device 10. It is also possible that the opening/closing devices 10 are disposed on the left and right of the vehicle body 13 and that the back door 12 is opened and closed by using the two opening/closing devices 10.

According to the invention, by fixing the motor and the rail member to the one base member, it is possible to improve the accuracy of the engagement of the pinion driven by the motor and the rack of the sliding member positioned by the rail member with each other. As a result, it is possible to increase power transferring efficiency in opening and closing the opening/closing member and to reduce wear in engaged faces of and generation of engaging sounds of the pinion and the rack.

If the pinion is provided as a separate body from the motor, by supporting the pinion by the base member to which the motor and the rail member are fixed, it is possible to improve the accuracy of the engagement of the pinion and the rack with each other.

Furthermore, by integrally forming the base member, it is possible to remove a factor of a decrease in positioning accuracy due to assembly of a base member and to further improve the accuracy of the engagement of the pinion and the rack with each other. By integrally forming the base member, it is possible to enhance rigidity of the base member and to maintain high accuracy of the engagement of the pinion and the rack with each other.

Furthermore, by integrally forming the base member, constraints on setting of positions of the motor fixing portion and the rail fixing portion are eased and the motor and the rail member can be gathered and disposed. As a result, the automatic opening/closing device for the vehicle can easily be downsized. It is also possible to reduce cost by reducing the number of parts.

What is claimed is:

1. An automatic opening/closing device for a vehicle, comprising:

an opening/closing member provided to a vehicle body so as to be automatically opened and closed;

a motor for generating a driving force for driving a pinion for rotation;

a rail member having a rail member length and a rail member width, the rail member length being substantially greater than the rail member width;

a sliding member having a sliding member width and sliding member length, the sliding member including a rack engaged with the pinion and being connected to the opening/closing member through a connecting member, the sliding member slidably mounted on the rail member such that the sliding member length and width are aligned respectively with the rail member length and width, the sliding member length being less than the rail member length, the sliding member width being greater than the rail member width, and the sliding member sharing a bearing surface with the rail member along substantially all of the sliding member length; and a base member to which the motor and the rail member are fixed respectively.

2. The automatic opening/closing device for a vehicle according to claim 1, wherein the pinion is rotatably supported on the base member.

3. The automatic opening/closing device for a vehicle according to claim 2, wherein the base member includes a motor fixing portion, a rail fixing portion, and a pinion support portion.

4. The automatic opening/closing device for a vehicle according to claim 1, wherein the base member includes a motor fixing portion and a rail fixing portion which are formed integrally.

5. The automatic opening/closing device for a vehicle according to claim 1, wherein the bearing surface is formed by an angular protrusion formed on a side of the rail member and a complementary angular recess formed on a side of the sliding member.

6. The automatic opening/dosing device for a vehicle according to claim 5, wherein the bearing surface further includes another angular protrusion formed on another side of the rail member and another complementary angular recess formed on another side of the sliding member.

7. An automatic opening/closing device for a vehicle, comprising:

an opening/closing member provided to a vehicle body so as to be automatically opened and closed;

a motor for generating a driving force for driving a pinion for rotation;

a sliding member which includes a rack engaged with the pinion and which is connected to the opening/closing member through a connecting member;

a rail member which positions the sliding member driven forward and rearward through the pinion and which positions in a width direction and guides in a straight moving direction the sliding member and which is formed longer than the sliding member; and a base member to which the motor and the rail member are fixed respectively;

wherein the base member includes a motor fixing portion and a rail fixing portion which are formed integrally; and wherein the rail fixing portion includes a plurality of ribs oriented perpendicularly to a longitudinal axis of the rail fixing portion, and a wall portion formed so as to surround the sliding member except where the rack engages the pinion and where the sliding member and the connecting member extend beyond the base member while being driven forward and rearward.

8. An automatic opening/closing device for a vehicle comprising:

an opening/closing member provided to a vehicle body so as to be automatically opened and closed;

a motor for generating a driving force for driving a pinion for rotation;

a rail member having a rail member length and a rail member width, the rail member length being substantially greater than the rail member width;

a sliding member having a sliding member width and sliding member length, the sliding member including a rack engaged with the pinion and being connected to the opening/closing member through a connecting member, the sliding member slidably mounted on the rail member such that the sliding member length and width are aligned respectively with the rail member length and width, the sliding member length being less than the rail member length, the sliding member sharing a bearing surface with the rail member along substantially all of the sliding member length; and a base member to which the motor and the rail member are fixed respectively;

wherein the sliding member substantially surrounds the rail member along the length of the sliding member, except where the rail member is fixed to the base member.

* * * * *